US005957101A

United States Patent [19]

Schmitz et al.

[11] Patent Number: 5,957,101

[45] Date of Patent: Sep. 28, 1999

[54] AUTOMATIC COMPRESSION RELEASE MECHANISM FOR AN INTERNAL COMBUSTION ENGINE

[75] Inventors: Gregory E. Schmitz, Neenah; Jerry R. Reineking, Cleveland; James P. Burke, Sheboygan, all of Wis.

[73] Assignee: Kohler Co., Kohler, Wis.

[21] Appl. No.: 08/891,630

[22] Filed: Jul. 9, 1997

[51] Int. Cl.[6] ..... F01L 13/08

[52] U.S. Cl. ..... 123/182.1; 123/321; 123/374

[58] Field of Search ..... 123/182.1, 321, 123/374

[56] References Cited

U.S. PATENT DOCUMENTS

| | | | |
|---|---|---|---|
| 2,259,983 | 10/1941 | Anderson | 123/182 |
| 2,850,002 | 9/1958 | Hövel | 123/182 |
| 3,314,408 | 4/1967 | Fenton | 123/182.1 |
| 3,362,390 | 1/1968 | Esty | 123/182 |
| 3,381,676 | 5/1968 | Campen | 123/182.1 |
| 3,395,689 | 8/1968 | Kruse | 123/182 |
| 3,496,922 | 2/1970 | Campen | 123/182 |
| 3,511,219 | 5/1970 | Esty | 123/182 |
| 3,620,203 | 11/1971 | Harkness | 123/182.1 |
| 3,897,768 | 8/1975 | Thiel | 123/182.1 |
| 3,901,199 | 8/1975 | Smith | 123/182 |
| 3,981,289 | 9/1976 | Harkness | 123/182.1 |
| 4,258,675 | 3/1981 | Volz et al. | 123/374 |
| 4,453,507 | 6/1984 | Braun et al. | 123/182.1 |
| 4,590,905 | 5/1986 | Matsuki et al. | 123/321 |
| 4,610,227 | 9/1986 | Nakano et al. | 123/182 |
| 4,615,313 | 10/1986 | Tsumiyama | 123/182 |
| 4,651,687 | 3/1987 | Yamashita et al. | 123/182.1 |
| 4,672,930 | 6/1987 | Sumi | 123/182 |
| 4,696,266 | 9/1987 | Harada | 123/182 |
| 4,892,068 | 1/1990 | Coughlin | 123/182 |
| 4,903,661 | 2/1990 | Scott | 123/374 |
| 5,085,184 | 2/1992 | Yamada et al. | 123/182.1 |
| 5,150,674 | 9/1992 | Gracyalny | 123/182.1 |
| 5,184,586 | 2/1993 | Buchholz | 123/182.1 |
| 5,197,422 | 3/1993 | Oleksy et al. | 123/182.1 |
| 5,317,999 | 6/1994 | Kern et al. | 123/182.1 |

*Primary Examiner*—Noah P. Kamen
*Assistant Examiner*—Jason Benton
*Attorney, Agent, or Firm*—Quarles & Brady LLP

[57] ABSTRACT

An internal combustion engine includes a mechanism for releasing compression from the cylinder during starting. That mechanism has an actuator attached to the engine camshaft for sliding between first and second positions. In first position the actuator is engaged by a lifter to open the engine exhaust valve during the compression phase of the combustion cycle. At the second position, the valve lifter does not engage the actuator and the exhaust valve remains closed during the compression phase. A weight lever is pivotally attached to the camshaft and drives the actuator between the first and second positions in response to engine speed. At slow speeds occurring while before the engine starts, the actuator is held the first position so that the compression is relieved. After the engine starts, centrifugal force causes the weight lever to drive the actuator into the second position at which normal compression occurs.

18 Claims, 2 Drawing Sheets

AUTOMATIC COMPRESSION RELEASE MECHANISM FOR AN INTERNAL COMBUSTION ENGINE

BACKGROUND OF THE INVENTION

The present invention relates to compression release mechanisms for internal combustion engines which operate a valve at slow speeds to release pressure within the engine cylinder during the compression portion of the combustion cycle.

It is desirable in internal combustion engines to reduce the force required to turn over the engine during starting. It is particularly advantageous to minimize starting forces in small internal combustion engines which are to be started by hand. In addition, such hand started engines must provide a mechanism to eliminate the danger of physical injury from engine kickback commonly caused by force from engine compression.

The chief cause of difficulty in turning over an internal combustion engine is the compression within the cylinder during a portion of the engine cycle. The prior art is replete with mechanisms to reduce that compression during starting. Early devices provided a manually operated valve which released the pressure from the cylinder. The disadvantage of a manual valve is that it must be quickly closed by the operator after cranking in order for the engine to start. Thus manually operated valves require a certain amount of skill in order to properly start the engine and are susceptible to operator oversight.

The prior art teaches a variety of automatic compression release mechanisms which are governed by the speed of the engine. At low speeds, the compression release mechanism opens a valve during the compression portion of the combustion cycle. When the speed increases above a given amount, the mechanism closes the valve enabling normal engine compression to occur.

Many automatic devices utilize the exhaust valve for the engine cylinder to release the compression while starting the engine. In this type of device, the compression release mechanism operated in conjunction with the camshaft on which a lifter for the exhaust valve rode. An example of such a mechanism is described in U.S. Pat. No. 4,892,068. This compression release device has a crescent shaped flyweight pivotally mounted to a gear on the camshaft and the flyweight rotates a cam pin into different positions depending upon engine speed. In one position, occurring at slow speeds, the cam pin raises an exhaust valve lifter from the surface of the camshaft during engine compression. After the engine starts, the greater speed causes the flyweight to rotate the cam pin into another position at which the pin no longer engages the exhaust valve lifter, allowing the engine to operate normally.

SUMMARY OF THE INVENTION

The general object of the present invention is to provide a mechanism which, while the engine is starting, opens a valve of the engine cylinder during the compression portion of the combustion cycle.

Another object to provide such a compression release mechanism which operates the conventional exhaust valve for the engine cylinder.

A further object of the present invention is to utilize centrifugal force produced by the engine to control the operation of the compression release mechanism.

Yet another object is to provide such a compression release mechanism which is mounted on the camshaft of the engine.

These and other objectives are satisfied by a compression release mechanism that includes an actuator slideably attached to the camshaft. The actuator has a first position at which its cam portion is adjacent to a cam surface on the engine camshaft so that a standard valve lifter engages the cam portion to open the engine exhaust valve during the compression portion of the combustion cycle. In a second position of the actuator, the cam portion is remote from the cam surface and the exhaust valve remains closed during the compression portion of the combustion cycle.

A weight lever is pivotally attached to the camshaft and engaging the actuator. Pivotal movement of the weight lever, in response to engine speed, causes the actuator to move along the camshaft between the first and second positions. Therefore at slow speeds, which occur during starting, the exhaust valve will be opened by the release mechanism to relieve engine compression. After the engine starts, the faster speed produces a centrifugal force which causes the weight lever to slide the actuator into the second position in which normal engine compression occurs.

DETAILED DESCRIPTION OF THE INVENTION

Figure 1:
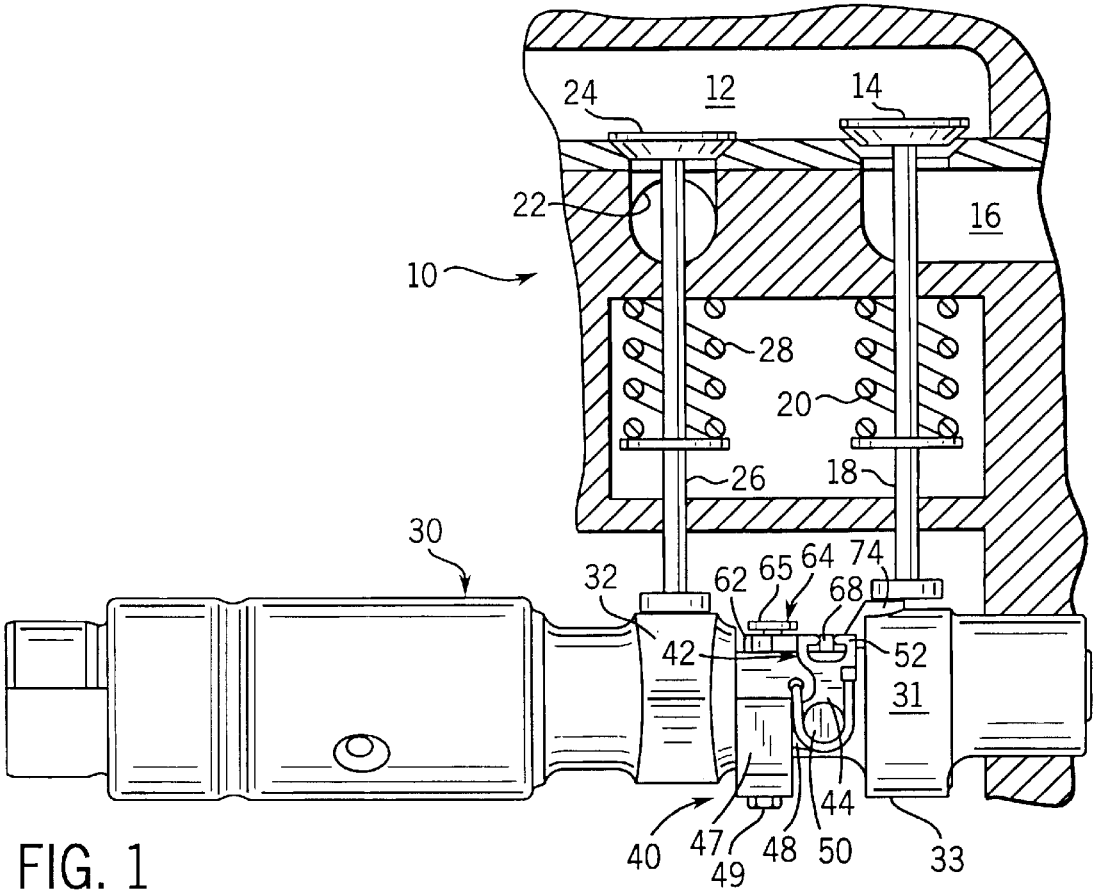
FIG. 1 is a cross-sectional view of a portion of an internal combustion engine incorporating the present invention.
Figure 2:
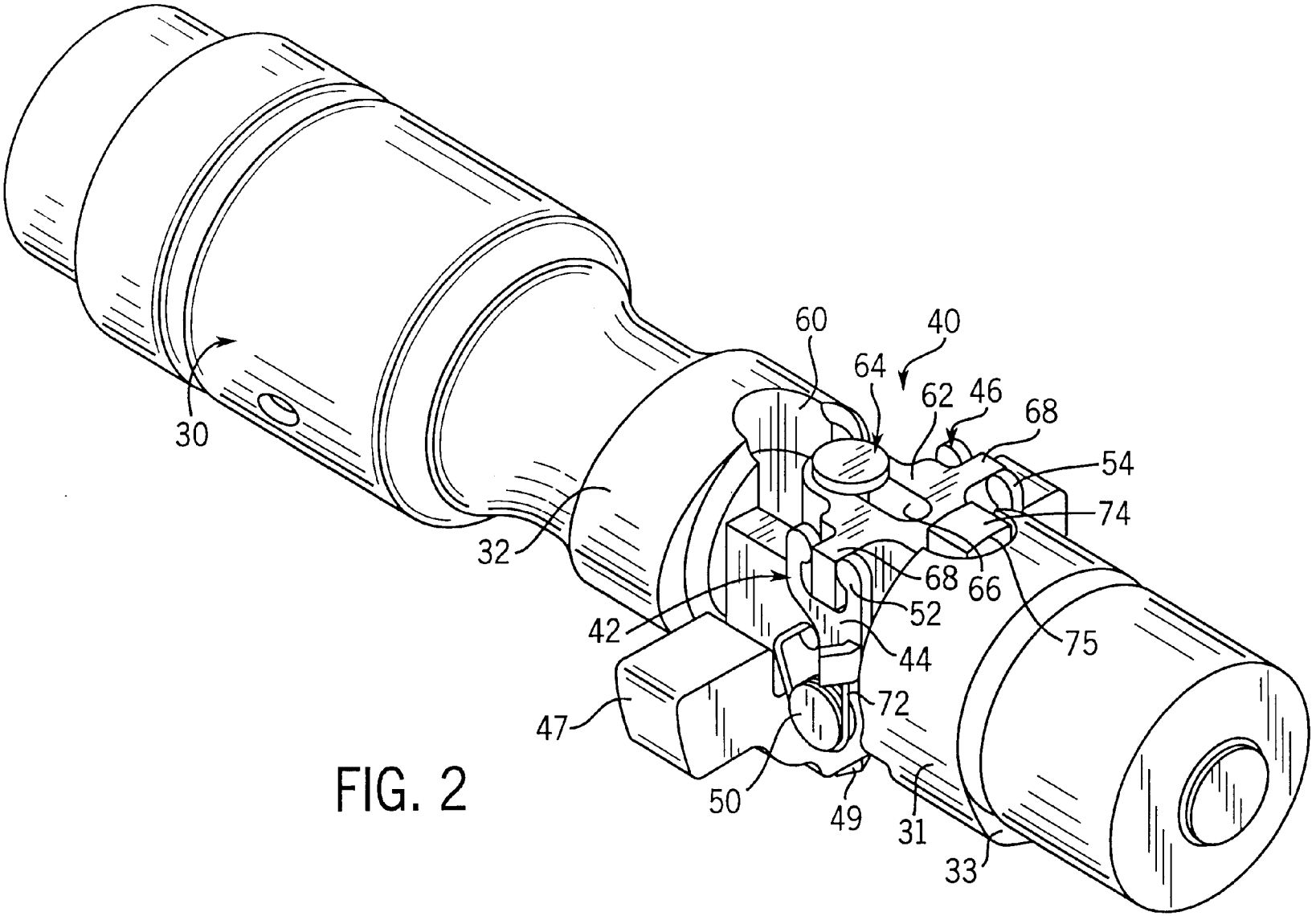
FIG. 2 is an isometric view of the camshaft and automatic compression release mechanism shown in FIG. 1.

With initial reference to FIGS. 1 and 2, an internal combustion engine, generally designated as 10, has a passage 12 which communicates with the engine cylinder (not shown). The passage 12 opens into an exhaust outlet 16 and has a valve 14 for selectively sealing the interface between the passage and the exhaust outlet. The exhaust valve 14 is mounted on a first valve lifter 18 which is biased by a spring 20 to maintain the valve in the closed state. The cylinder passage 12 also communicates with a fuel inlet port 22. An intake valve 24 is attached to a second valve lifter 26 which is biased by a spring 28 to maintain the intake valve 24 in the closed position as illustrated in FIG. 1.

The remote end of the two valve lifters 18 and 26 engage a camshaft 30 having a longitudinal axis. The camshaft 30 includes a first cam surface 31 which is followed by the first valve lifter 18. The cam surface 31 has a lobe 33 that pushes the first valve lifter 18 upward, when the camshaft is at first angular position, to open the exhaust valve 14 and release combustion gases from the engine cylinder. The camshaft 30 also includes a second cam surface 32, which is followed by the second valve lifter 26 to open the intake valve 24 and allow a fuel mixture to enter the cylinder from a carburetor. The operation of the exhaust and intake valves 14 and 24 have a conventional timing relationship to the movement of the piston within the engine cylinder. This timing relationship is maintained by a timing gear (not shown) attached to the camshaft 30 and meshing with a gear on the piston crankshaft.

The engine 10 further comprises a compression release mechanism 40 mounted on the camshaft 30. This compression release mechanism 40 comprises a U-shaped weight lever 42 which straddles the camshaft 30 between the first and second cam surfaces 31 and 32. The weight lever 42 has two arms 44 and 46 on opposite sides of the camshaft 30 and connected by a cross member 48 and a weight 47 is fastened to the cross member 48 by a screw 49. A pivot pin 50, in the form of a rivet, extends through each arm 44 and 46 and through a transverse aperture in the camshaft 30. As will be described, the pivot pin connection allows the weight lever 42 to pivot about camshaft 30 in response to centrifugal force produced when the camshaft rotates about its longitudinal axis. The ends of arms 44 and 46 which are remote from the cross member 48 have Y-shaped forks 52 and 54, respectively.

The camshaft 30 has a longitudinal groove 60 with a flat bottom. A slide actuator 62 is held within that groove by a slider pin 64 which passes through a slot 66 in the slide actuator 62 and into an aperture in the camshaft 30. The slider pin 64, with an enlarged head 65, loosely holds the slide actuator 62 within the groove 60 allowing movement along the length of the groove. The slide actuator 62 has a pair of projections 68 extending laterally outward. The projections 68 project into the center notch 75 in the forks 52 and 54 at the end of the arms 44 and 46 of the weight lever 42. As will be described, this engagement of the projections causes pivotal movement of the weight lever 42 to produce translational movement of the slide actuator 62.

The weight lever 42 is biased into a position illustrated in FIGS. 1 and 2 by a torsional spring 72, which is wrapped around the pivot pin 50 with ends engaging the camshaft 30 and the weight lever. Due to the spring force, the compression release mechanism 40 assumes this position when the engine is stopped or is operating at relatively slow speeds as occur during starting of the engine. In this position, a cam portion 74 of the slide actuator 62 extends into a notch 75 in the first cam surface 31 associated with the exhaust valve 14.

When so positioned, the cam portion 74 of the slide actuator 62 projects above the first cam surface 31 providing a second lobe which is engaged by the first valve lifter 18 for exhaust valve 14. This additional lobe is located at an angular position on the camshaft 30 so that the slide actuator 62 engages the first valve lifter 18 during the compression portion of the combustion cycle. Thus, at relatively slow engine speeds during engine starting, the first valve lifter 18 will be engaged by the cam portion 74 of the slide actuator 62, thereby opening the exhaust valve 14 as illustrated in FIG. 1. This action releases compression within the engine cylinder, thereby less force is required to rotate the engine during starting.

This compression release mechanism 40 is particularly advantageous in small gasoline-powered internal combustion engines which are started by hand. For example, single cylinder engines used on lawn and garden equipment typically are started by the operator pulling a cord that is wrapped around a pulley on the engine crankshaft. Thus, while the engine is being turned over manually, compression within the cylinder is released making it easier for the operator to pull the cord and start the engine.

The cam portion 74 of the slide actuator 62 has a curved contour. Thus, the end of the first valve lifter 18 makes a smooth transition from the first cam surface 31 onto and off of the cam portion 74 when the slide actuator 62 is positioned as illustrated in FIGS. 1 and 2. These smooth transitions reduce the amount of noise associated with the operation of the compression release mechanism 40, as the end of the first valve lifter 18 is not making an abrupt, step-wise transition off the cam portion 74 onto the first cam surface 31.

Figure 3:
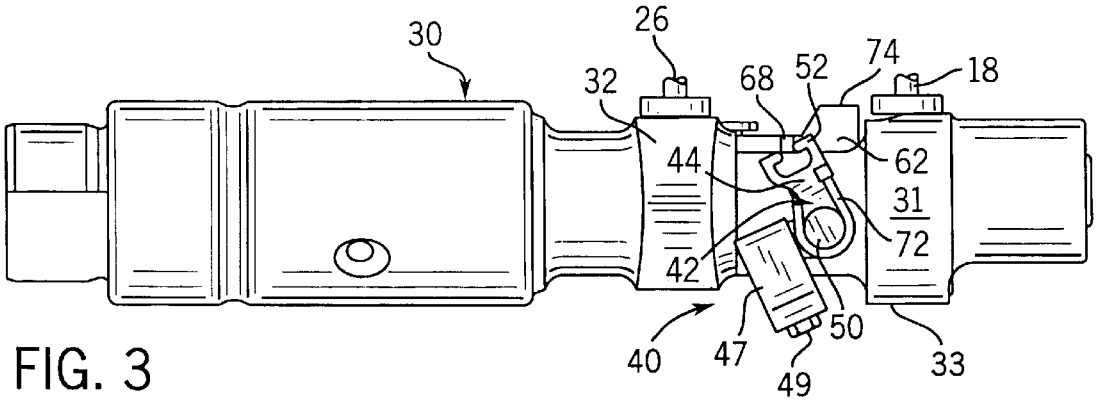
FIG. 3 is a plane view of the camshaft and automatic compression release mechanism in another state of operation from that shown in the previous figures.

As the speed of the engine increases, the centrifugal forces acting on the weight lever 42, in particular the cross member 48 and weight 47, exceed the force of the torsional spring 72 causing the weight lever to rotate about the pivot pin 50 as illustrated in FIG. 3. When this pivoting occurs, the cross member 48 of the weight lever 42 moves away from the exterior surface of the camshaft 30. The pivotal action causes the forks 52 and 54 at the ends of the weight lever arms 44 and 46 to push against the two projections 68 applying force which causes the slide actuator 62 to move longitudinally within groove 60 on the surface of the camshaft 30. As the slide actuator 62 moves within the groove 60, the cam portion 74 moves out of the notch 75 in the first cam surface 31. Eventually, the speed of the engine increases to the point where the centrifugal force acting on the weight lever 42 cause the slide actuator 62 to move completely out of camshaft notch 75, into the position illustrated in FIG. 3.

With the slide actuator 62 so positioned, the first valve lifter 18 rides entirely on the first cam surface 31 and does not encounter an additional lobe previously provided by the slide actuator cam portion 74. As a consequence, during the compression portion of the engine cycle, the exhaust valve 14 remains closed and does not open to relieve the compression force. Therefore, the combustion cycle will produce normal compression of the air-fuel mixture at speeds typically encountered after the engine starts.

We claim:

1. In an internal combustion engine having an exhaust valve, an exhaust valve lifter, a camshaft having a shaft portion with a cam surface engaged by the exhaust valve lifter to open the exhaust valve at a first angular position of the camshaft; a compression release mechanism comprising:

an actuator slideably attached to the camshaft and including a cam portion, the actuator having a first position at which the cam portion is adjacent to the cam surface and engagable by the exhaust valve lifter to open the exhaust valve at a second angular position of the camshaft, and having a second position at which the cam portion is remote from the cam surface so that the exhaust valve is closed at the second angular position of the camshaft; and a weight lever engaging the actuator to drive the actuator between the first and second positions in response to engine speed, the weight lever coupled to the camshaft and pivoting about an axis which intersects the shaft portion.

2. The compression release mechanism as recited in claim 1 further comprising a spring exerting a force which biases the actuator into the first position.

3. The compression release mechanism as recited in claim 1 wherein the weight lever has a U-shape formed by two arms connected by a cross member, wherein the weight lever straddles the camshaft and the two arms are coupled to the actuator.

4. The compression release mechanism as recited in claim 1 further comprising a weight attached to the weight lever.

5. In an internal combustion engine having an exhaust valve, an exhaust valve lifter, a camshaft having a shaft portion with a cam surface engaged by the exhaust valve lifter to open the exhaust valve at a first angular position of the camshaft; a compression release mechanism comprising:

an actuator attached to slide longitudinally along the camshaft and including a cam portion, the actuator having a first position at which the cam portion is adjacent to the cam surface and engaged by the exhaust valve lifter to open the exhaust valve at a second angular position of the camshaft, and having a second position at which the cam portion is remote to the cam surface so that the exhaust valve is closed at the second angular position of the camshaft; and a weight lever pivotally attached to the camshaft and pivoting about an axis which intersects the shaft portion, the weight lever engaging the actuator wherein pivotal movement of the weight lever in response to engine speed causes the actuator to move along the camshaft between the first and second positions.

6. The compression release mechanism as recited in claim 5 wherein the weight lever is attached to the camshaft by a pivot pin.

7. The compression release mechanism as recited in claim 5 wherein the weight lever has a U-shape formed by two arms connected by a cross member, wherein the weight lever straddles the camshaft.

8. The compression release mechanism as recited in claim 7 wherein the weight lever has a separate fork at ends of the two arms with a coupling which engages each fork to couple the weight lever to the actuator.

9. The compression release mechanism as recited in claim 8 wherein the coupling comprises a pair of projections extending from the actuator.

10. The compression release mechanism as recited in claim 7 wherein the weight lever has a separate fork at ends of the two arms; and the actuator has two projections each engaging a different fork of the weight lever.

11. The compression release mechanism as recited in claim 5 wherein the actuator has an elongated slot with a pin extending therethrough and into the camshaft.

12. The compression release mechanism as recited in claim 5 further comprising a spring exerting a force which biases the actuator into the first position.

13. The compression release mechanism as recited in claim 5 further comprising a weight attached to the weight lever.

14. In an internal combustion engine having an exhaust valve, an exhaust valve lifter, a camshaft having a cam surface engaged by the exhaust valve lifter to open the exhaust valve at a first angular position of the camshaft; a compression release mechanism comprising:

a weight lever having a pair of arms with the camshaft extending therebetween and a cross member connected between the pair of arms, the pair of arms being pivotally attached to the camshaft; and a slide actuator slideably attached to the camshaft and including a cam portion, the slide actuator having a first position at which the cam portion is proximate to the cam surface and is engaged by the exhaust valve lifter to open the exhaust valve at a second angular position of the camshaft, and having a second position at which the cam portion is remote to the cam surface so that the exhaust valve is closed at the second angular position of the camshaft, the slide actuator further having a pair of projections each engaging a different one of the pair of arms wherein pivotal movement of the weight lever produces movement of the slide actuator between the first and second positions.

15. The compression release mechanism as recited in claim 14 further comprising a spring exerting a force which biases the actuator into the first position.

16. The compression release mechanism as recited in claim 14 wherein each one of the pair of arms has a notch within which one of the projections of the slide actuator is received.

17. The compression release mechanism as recited in claim 14 wherein the slide actuator has an elongated slot; and further comprising a slider pin extending through the elongated slot and into the camshaft.

18. The compression release mechanism as recited in claim 14 further comprising a weight attached to the weight lever.

* * * * *